US009004732B2

(12) United States Patent
Lee

(10) Patent No.: US 9,004,732 B2
(45) Date of Patent: Apr. 14, 2015

(54) LAMP FOR VEHICLE

(71) Applicant: Hyundai Mobis Co., Ltd., Seoul (KR)

(72) Inventor: Hyun Soo Lee, Yongin (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 14/080,891

(22) Filed: Nov. 15, 2013

(65) Prior Publication Data

US 2015/0062947 A1 Mar. 5, 2015

(30) Foreign Application Priority Data

Aug. 29, 2013 (KR) ..... 10-2013-0103209

(51) Int. Cl.
*F21S 8/10* (2006.01)

(52) U.S. Cl.
CPC ..... *F21S 48/1388* (2013.01); *F21S 48/115* (2013.01); *F21S 48/1159* (2013.01)

(58) Field of Classification Search
CPC ..... F21S 48/1159; F21S 48/1388
USPC ..... 362/539, 516
See application file for complete search history.

(56) References Cited

U.S. PATENT DOCUMENTS

2012/0039083 A1* 2/2012 Meyrenaud ..... 362/516

FOREIGN PATENT DOCUMENTS

| | | | |
|---|---|---|---|
| JP | 2001-184912 | A | 7/2001 |
| JP | 4969958 | B2 | 7/2012 |
| JP | 2012-524958 | A | 10/2012 |
| KR | 10-2013-0019982 | A | 2/2013 |

OTHER PUBLICATIONS

Korean Office Action issued Oct. 16, 2014 in counterpart Korean Patent Application No. 10-2013-0103209 (4 pages, in Korean).

* cited by examiner

*Primary Examiner* — Mary Ellen Bowman
(74) *Attorney, Agent, or Firm* — NSIP Law

(57) ABSTRACT

The present invention provides a lamp for a vehicle including: a lamp module including: a lens having a first focal point; a shield formed behind the lens; a first reflector formed above the shield and having a second focal point; and a second reflector formed below the shield and having a third focal point, in which an edge of the shield and the second focal point are formed to be positioned on the first focal point, and the third focal point is formed behind and below the first focal point, thereby implementing a low beam and a high beam using a single optical module and greatly reducing a size, a weight, and the number of components.

9 Claims, 4 Drawing Sheets

LAMP FOR VEHICLE

CROSS-REFERENCE TO RELATED APPLICATIONS

This application claims priority to and the benefit of Korean Patent Application No. 10-2013-0103209 filed in the Korean Intellectual Property Office on Aug. 29, 2013, the entire contents of which are incorporated herein by reference.

TECHNICAL FIELD

The present invention relates to a lamp for a vehicle, and more particularly, to a lamp for a vehicle capable of implementing a low beam and a high beam using a single lamp module.

BACKGROUND ART

In general, lighting devices are provided in a vehicle to stably secure visibility of a driver when the level of illumination is low at the periphery of a vehicle while the vehicle runs. Among the lighting devices, a headlamp is mainly used to secure a stable visual range of the driver.

The headlamp may selectively irradiate forward a low beam and a high beam with differences in irradiation angles of light irradiated from a light source and a light amount. The process of selectively irradiating the low beam and the high beam may be performed by the driver's operation of turning a switch on and off, or may be automatically switched in accordance with a running state of the vehicle.

FIG. 1 is a view illustrating a lamp for a vehicle capable of selectively irradiating a low beam and a high beam using a single optical module.

Referring to FIG. 1, a lamp 10 for a vehicle includes a bulb 11 configured to serve as a light source for irradiating light, and a shield 14 configured to block a part of the light irradiated from the bulb 11 so as to produce a high beam HL or a low beam LL. Here, as the light source, a light emitting diode (LED) may be used instead of the bulb 11.

Here, the shield 14 is installed in a lamp housing so as to be rotatable about a rotation axis 12, and a solenoid 16 is connected to the shield 14 so as to rotate the shield 14.

When the solenoid 16 is operated, the shield 14 is rotated about the rotation axis 12 thereof so as to produce the high beam HL or the low beam LL. That is, when the shield 14 is vertically positioned by the solenoid 16, as illustrated in FIG. 1, a part of the light is blocked such that the low beam LL is produced. In contrast, when the shield 14 is horizontally positioned, the light is not blocked such that the high beam HL, which is irradiated more upward than the low beam LL, is produced.

However, the lamp for a vehicle, which uses the solenoid in order to rotate the shield, has a problem in that manufacturing costs are increased because the number of components is increased. There are problems in that lifespans of operating components are limited, durability deteriorates, and the overall weight of the lamp for a vehicle is increased due to the component such as the solenoid. There is a problem in that it is difficult to produce a desired optical pattern because of an operational error of the shield.

SUMMARY OF THE INVENTION

The present invention has been made in an effort to provide a lamp for a vehicle capable of implementing a low beam and a high beam using a single optical module and reducing a size, a weight, and the number of components.

The present invention has also been made in an effort to provide a lamp for a vehicle capable of reducing interference between a low beam and a high beam.

An exemplary embodiment of the present invention provides a lamp for a vehicle including: a lamp module including: a lens having a first focal point; a shield formed behind the lens; a first reflector formed above the shield and having a second focal point; and a second reflector formed below the shield and having a third focal point, in which an edge of the shield and the second focal point are formed to be positioned on the first focal point, and the third focal point is formed behind and below the first focal point.

The lens may be an aspherical lens.

The first reflector and the second reflector may include an elliptical reflective surface.

A lower surface of the shield may be formed to be inclined with respect to an upper surface of the shield.

An inclination angle between the lower surface of the shield and the upper surface of the shield may be 15° or less.

The third focal point may be formed 1 mm or less behind the first focal point, and formed 1 mm or less below the first focal point.

The lamp module may include a first light source configured to implement a low beam, and a second light source configured to implement a high beam.

The first light source may be formed on an upper surface of a substrate of the lamp module, and the second light source may be formed on a lower surface of the substrate of the lamp module.

The first light source and the second light source may be a light emitting diode (LED).

According to the lamp for a vehicle of the present invention, a horizontally installed-type shield having an upper surface for blocking a part of the light of the first light source which implements a low beam and a lower surface for blocking a part of the light of the second light source which implements a high beam is provided, and the focal point of the second reflector which reflects the light that implements the high beam is formed behind and below the focal point of the lens and the focal point of the first reflector, thereby providing an advantageous effect of implementing the low beam and the high beam using a single optical module and greatly reducing a size, a weight, and the number of components.

According to the lamp for a vehicle of the present invention, the shield blocks the light irradiated toward a position behind the focal point of the lens, thereby providing an advantageous effect of blocking in advance the light that is irradiated above the lens after passing through the lens.

According to the lamp for a vehicle of the present invention, there is an advantageous effect of reducing interference between the low beam and the high beam by using the shield, which is installed horizontally, when the first light source configured to implement the low beam and the second light source configured to implement the high beam are turned on at the same time.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
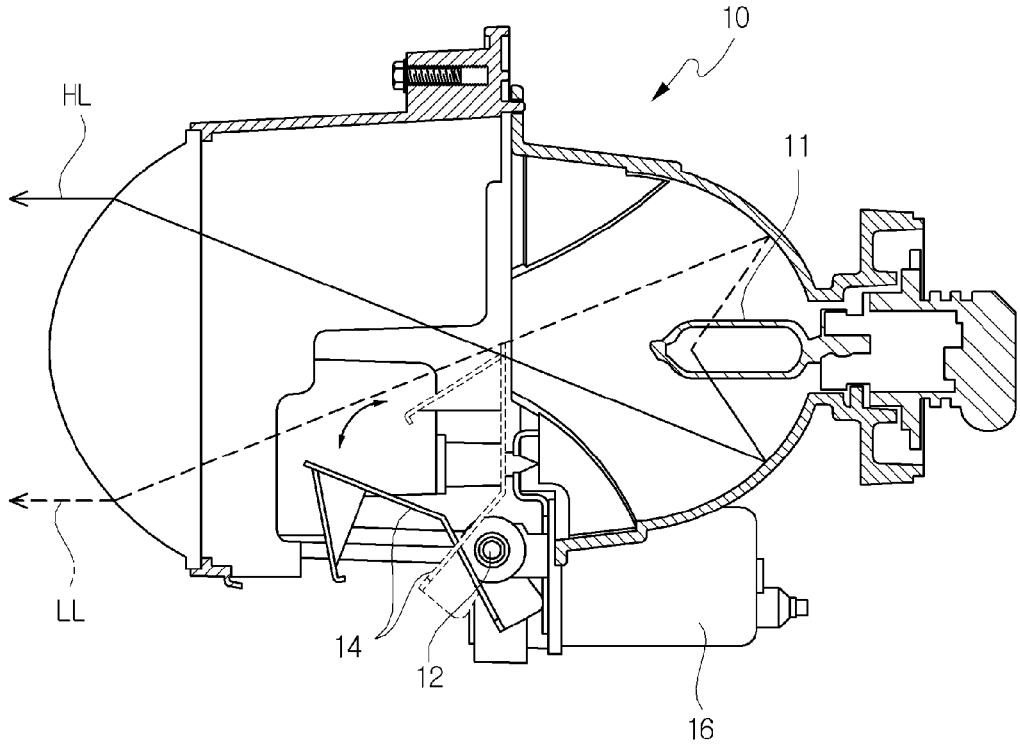
FIG. 1 is a view illustrating a lamp for a vehicle capable of selectively irradiating a high beam and a low beam using a single optical module.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. First, in denoting reference numerals to constituent elements of respective drawings, the same elements will be designated by the same reference numerals although they are shown in different drawings. An exemplary embodiment of the present invention will be described below, but the technical spirit of the present invention is not limited thereto and may be modified and variously implemented by those skilled in the art.

Figure 2:
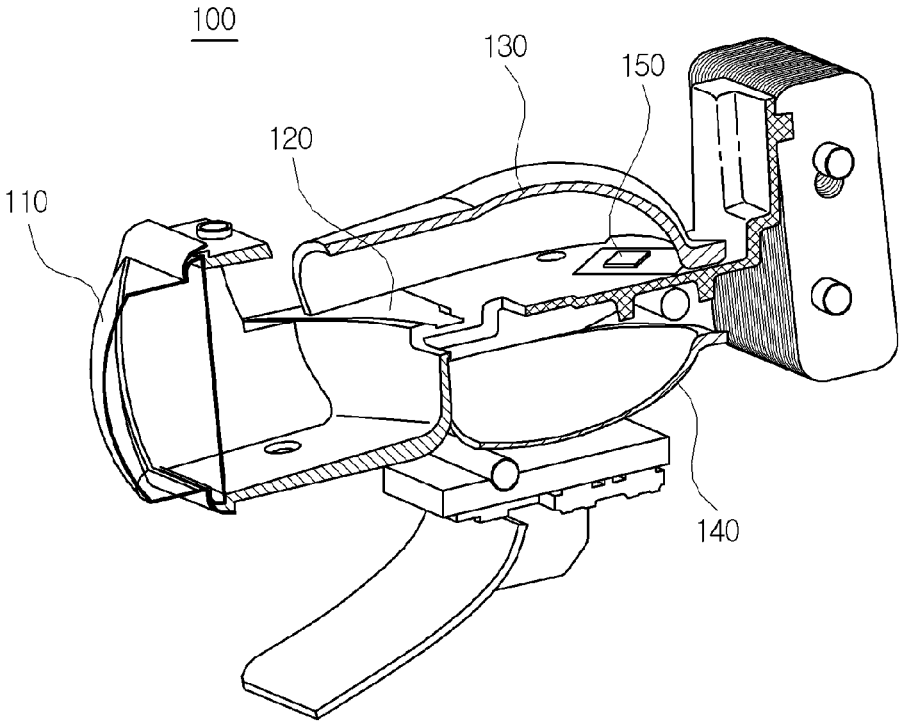
FIGS. 2 and 3 are views illustrating a lamp for a vehicle according to an exemplary embodiment of the present invention.
Figure 3:
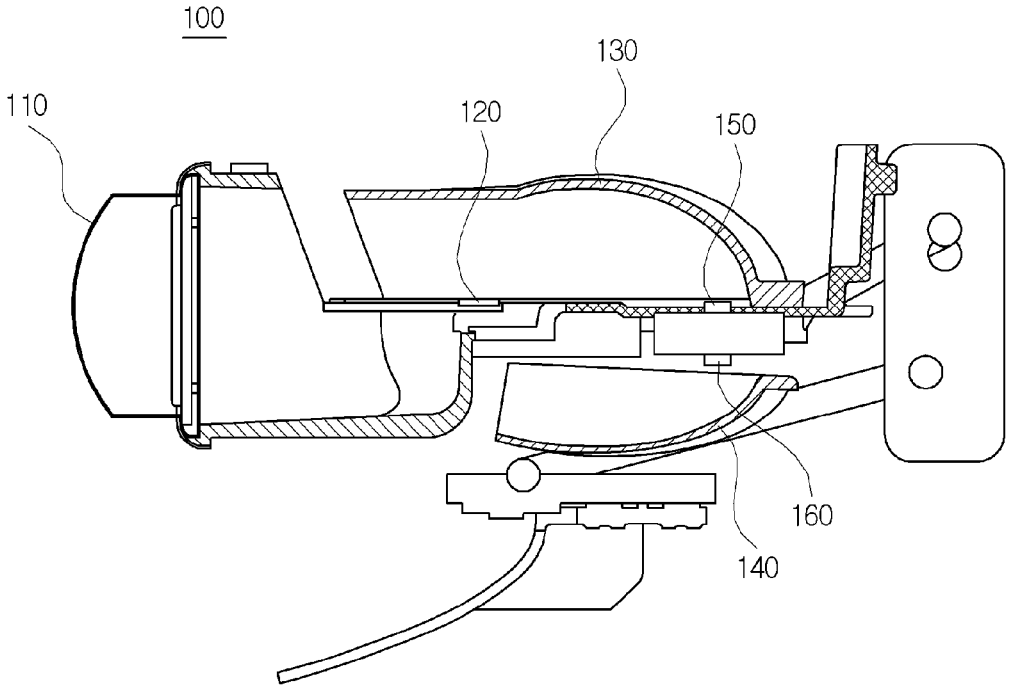
Figure 4:
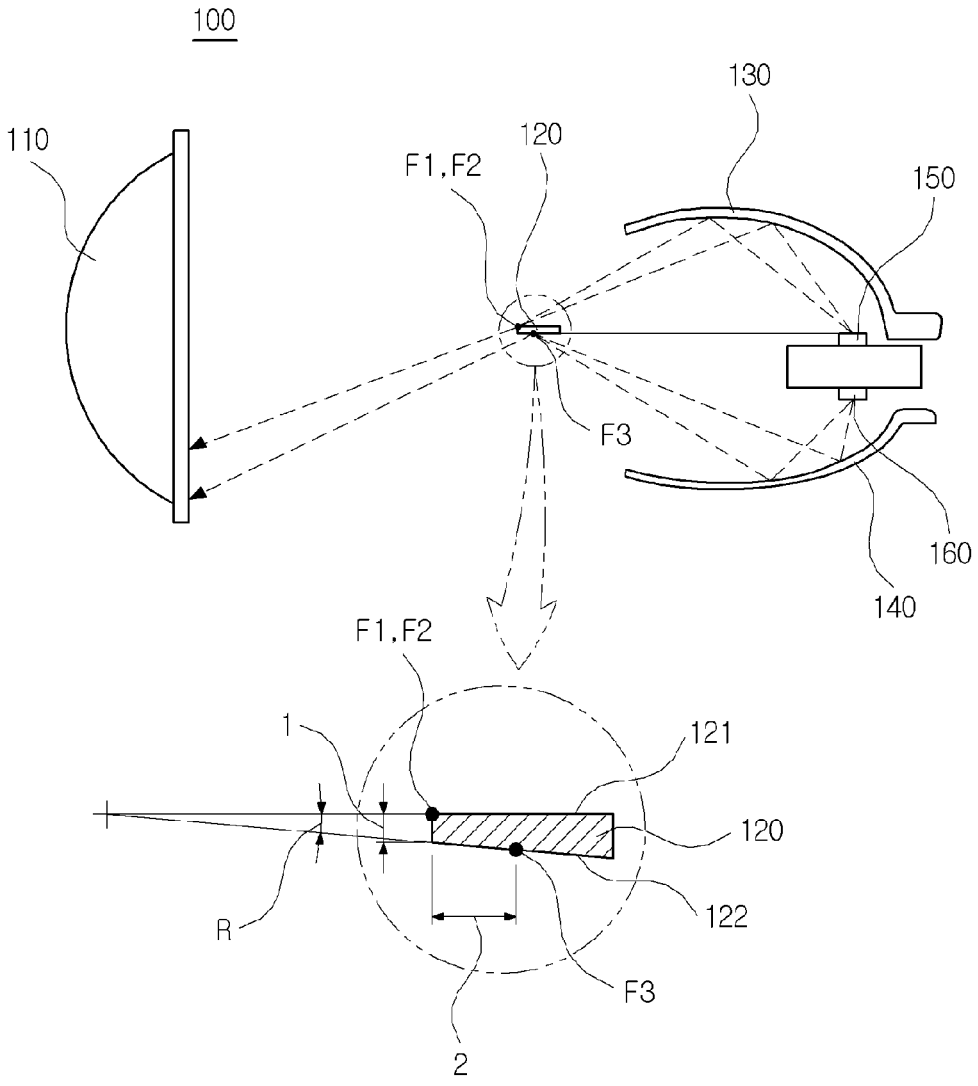
FIG. 4 is a view illustrating a light path of the lamp for a vehicle illustrated in FIGS. 2 and 3.

FIGS. 2 and 3 are views illustrating a lamp for a vehicle according to an exemplary embodiment of the present invention, and FIG. 4 is a view illustrating a light path of the lamp for a vehicle illustrated in FIGS. 2 and 3. FIGS. 2 to 4 clearly illustrate only main characteristic parts for conceptual and clear understanding of the present invention. As a result, various modifications to the illustrations are expected, and the scope of the present invention does not have to be limited to specific shapes illustrated in the drawings.

Referring to FIGS. 2 to 4, a lamp 100 for a vehicle according to an exemplary embodiment of the present invention includes a lamp module including an aspherical lens 110, a shield 120 formed behind the aspherical lens 110, a first reflector 130 formed above the shield 120, and a second reflector 140 formed below the shield 120.

Hereinafter, when the lamp 100 for a vehicle according to the exemplary embodiment of the present invention is described, the term "front" on the basis of the shield 120 means a direction from the shield 120 toward the lens 110, and the term "behind" on the basis of the shield 120 means a direction from the shield 120 toward a first light source 150 and a second light source 160.

The light passing through a focal point F1 of the aspherical lens 110 goes straight after passing through the aspherical lens 110.

The shield 120 may be formed as a thin plate that is horizontally formed. Here, the shield 120 is disposed horizontally so that an edge of the shield 120 is positioned on the focal point F1 of the aspherical lens 110. The edge of the shield 120 may have a thickness of 0.1 mm, and the edge of the shield 120 may be formed concavely along the focal points F1 of the aspherical lens 110.

The first reflector 130 is disposed above the shield 120. Here, the first reflector 130 may include an elliptical reflective surface having two focal points. The first reflector 130 may be formed so that the first light source 150 is positioned on any one focal point of the two focal points of the first reflector 130, and the other focal point F2 is positioned on the focal point F1 of the aspherical lens 110. The first reflector 130 reflects the light irradiated from the first light source 150 toward the aspherical lens 110.

The second reflector 140 is disposed below the shield 120. Here, the second reflector 140 may include an elliptical reflective surface having two focal points. The second reflector 140 may be formed so that the second light source 160 is positioned on any one focal point of the two focal points of the second reflector 140, and the other focal point F3 is positioned below and behind the focal point F1 of the aspherical lens 110 and the focal point F2 of the first reflector 130.

Specifically, as illustrated in FIG. 4, the second reflector 140 may be disposed so that the focal point F3 of the second reflector 140 is formed below the focal point F1 of the aspherical lens 110 and the focal point F2 of the first reflector 130 by "1" indicated in FIG. 4 on the basis of a height direction. Here, "1" of FIG. 4 may be 1 mm or less.

As illustrated in FIG. 4, the second reflector 140 may be disposed so that the focal point F3 of the second reflector 140 is formed behind the focal point F1 of the aspherical lens 110 and the focal point F2 of the first reflector 130 by "2" indicated in FIG. 4 on the basis of a direction in which the light is irradiated. Here, "2" of FIG. 4 may be 1 mm or less.

As such, the reason for forming the focal point F3 of the second reflector 140 below and behind the focal point F1 of the aspherical lens 110 and the focal point F2 of the first reflector 130 is to effectively implement the high beam in consideration of the thickness of 0.1 mm of the edge of the shield 120 that is disposed in a horizontal direction.

The shield 120 horizontally formed between the first reflector 130 and the second reflector 140 blocks light, which reaches positions behind the first focal point F2 and the second focal point F3, respectively, so as to greatly reduce light interference occurring when the first light source 150 and the second light source 160 are turned on at the same time.

Unlike a shield of the related art which is driven by a solenoid, since the shield 120 is fixed in a lamp housing, there is an advantage in that reliability and accuracy of a light pattern are high.

The first light source 150 may be formed on an upper surface of a substrate of the lamp module, and the second light source 160 may be formed on a lower surface of the substrate of the lamp module so as to be positioned below the first light source 150. The first light source 150 is positioned on any one focal point of the two focal points of the first reflector 130 and irradiates light, which implements the low beam, toward the first reflector 130. The second light source 160 is positioned on the other focal point of the two focal points of the second reflector 140 and irradiates light, which implements the high beam, toward the second reflector 140.

Here, the first light source 150 and the second light source 160 may be a light emitting diode (LED).

Referring to FIG. 4, a part of the light irradiated from the first light source 150 and reflected by the first reflector 130, which may be used to implement the high beam, is reflected and blocked by an upper surface 121 of the shield 120. The light reflected by the shield 120 as described above passes through the aspherical lens 110 so as to implement the low beam.

A part of the light irradiated from the second light source 160 and reflected by the second reflector 140, which may be used to implement the low beam, is reflected and blocked by a lower surface 122 of the shield 120. The light reflected by the shield 120 passes through the aspherical lens 110 so as to implement the high beam.

Here, the lower surface 122 of the shield 120 may be formed to be inclined with respect to the upper surface 121 that is formed horizontally. Specifically, an inclination angle R between the lower surface 122 and the upper surface 121 of the shield 120 may be 15° or less.

The reason for forming the lower surface 122 of the shield 120 to be inclined is to sufficiently use the light reflected by the second reflector 140 to implement the high beam considering that the focal point F3 of the second reflector 140 is formed below and behind the focal point F1 of the aspherical lens 110 and the focal point F2 of the first reflector 130.

Meanwhile, the lamp 100 for a vehicle according to the exemplary embodiment of the present invention may greatly reduce the number of components in comparison with the lamp for a vehicle of the related art which includes two lamp modules so as to implement the low beam and the high beam.

For example, it is possible to substitute a shield assembly, which is formed to be able to be driven by including a solenoid, with a horizontally installed-type shield, and it is possible to reduce the number of components such as a lens, a housing, a reflector, and a heat sink. Therefore, the lamp 100 for a vehicle according to the exemplary embodiment may greatly reduce a weight and a size of the lamp module per se.

Accordingly, the lamp 100 for a vehicle according to the exemplary embodiment provides an effect of improving reliability and accuracy of a light pattern and reducing manufacturing costs.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A lamp for a vehicle comprising:

a lens having a first focal point;

a shield formed behind the lens;

a first reflector formed above the shield and having a second focal point; and a second reflector formed below the shield and having a third focal point, wherein an edge of the shield and the second focal point are positioned on the first focal point, and the third focal point is formed on a surface of the shield that is behind and below the first focal point.

2. The lamp of claim 1, wherein the lens is an aspherical lens.

3. The lamp of claim 1, wherein the first reflector and the second reflector comprise an elliptical reflective surface.

4. The lamp of claim 1, wherein a lower surface of the shield is formed to be inclined with respect to an upper surface of the shield.

5. The lamp of claim 4, wherein an inclination angle between the lower surface of the shield and the upper surface of the shield is 15° or less.

6. The lamp of claim 1, wherein the third focal point is formed 1 mm or less behind the first focal point, and formed 1 mm or less below the first focal point.

7. The lamp of claim 6, wherein the lamp further comprises a first light source configured to implement a low beam, and a second light source configured to implement a high beam.

8. The lamp of claim 7, wherein the first light source is formed on an upper surface of a substrate of the lamp, and the second light source is formed on a lower surface of the substrate of the lamp.

9. The lamp of claim 7, wherein the first light source and the second light source are a light emitting diode (LED).

* * * * *